United States Patent [19]

Kida et al.

[11] Patent Number: 4,751,800

[45] Date of Patent: Jun. 21, 1988

[54] OPENABLE DOME-SHAPED ROOF STRUCTURE

[75] Inventors: Yukio Kida, Tokyo; Sunao Shotaka, Soka; Toshio Adachi, Yawata; Toru Aoyagi, Tokyo; Shigeki Yamanaka, Kobe, all of Japan

[73] Assignee: Ohbayashi-Gumi, Ltd., Osaka, Japan

[21] Appl. No.: 882,979

[22] PCT Filed: Dec. 26, 1985

[86] PCT No.: PCT/JP85/00725

§ 371 Date: Jun. 25, 1986

§ 102(e) Date: Jun. 25, 1986

[87] PCT Pub. No.: WO86/04371

PCT Pub. Date: Jul. 31, 1986

[30] Foreign Application Priority Data

| | | | |
|---|---|---|---|
| Jan. 23, 1985 | [JP] | Japan | 60-9136 |
| Jan. 23, 1985 | [JP] | Japan | 60-9137 |
| Jun. 19, 1985 | [JP] | Japan | 60-131657 |
| Aug. 14, 1985 | [JP] | Japan | 60-123961[U] |
| Nov. 13, 1985 | [JP] | Japan | 60-173613[U] |
| Nov. 19, 1985 | [JP] | Japan | 60-257638 |

[51] Int. Cl.[4] ..... E04B 1/346

[52] U.S. Cl. ..... 52/66; 52/82

[58] Field of Search ..... 52/82, 66

[56] References Cited

U.S. PATENT DOCUMENTS

| | | | |
|---|---|---|---|
| 1,193,833 | 8/1916 | Sherman | 52/82 |
| 1,240,182 | 9/1917 | Douthitt | 52/82 |
| 2,716,993 | 9/1955 | Coderick | 52/82 |
| 3,815,299 | 6/1974 | Sörensen | 52/66 |
| 3,835,602 | 9/1974 | Tuuri | 52/82 |

FOREIGN PATENT DOCUMENTS

| | | | |
|---|---|---|---|
| 772349 | 11/1967 | Canada . | |
| 235066 | 6/1911 | Fed. Rep. of Germany | 52/66 |
| 44-15345 | 7/1969 | Japan . | |
| 44-15346 | 7/1969 | Japan . | |
| 47-32620 | 8/1972 | Japan . | |
| 60-85137 | 5/1985 | Japan . | |
| 60-88744 | 5/1985 | Japan . | |
| 320475 | 2/1970 | Sweden | 52/66 |
| 613249 | 9/1979 | Switzerland . | |
| 318237 | 1/1972 | U.S.S.R. | 52/66 |

*Primary Examiner*—Henry E. Raduazo

*Attorney, Agent, or Firm*—Wenderoth, Lind & Ponack

[57] ABSTRACT

A dome-shaped roof structure for a large construction such as an athletic stadium is capable of partly opening according to the environmental conditions such as weather conditions. The dome-shaped roof structure includes a stationary roof section having a central opening and fixedly secured along an outer periphery thereof to the side wall of the large construction, and a movable roof section including a plurality of roof units corresponding to a plurality of divisions of the central opening and each capable of being radially moved between an open position where the roof unit is supported on the stationary roof section and a closed position where the roof unit is supported on a beam in the central opening.

2 Claims, 19 Drawing Sheets

OPENABLE DOME-SHAPED ROOF STRUCTURE

TECHNICAL FIELD

The present invention relates to a dome-shaped roof structure and, more particularly, to a dome-shaped roof structure capable of being closed or partly opened according to weather conditions.

BACKGROUND ART

As is generally known, structures for athletic games, such as baseball games and other athletic sports, are not provided with a roof so that athletic activities can be practiced in a natural environment. However, without a roof, athletic activities are obliged to be interrupted or to be called off if rain begins to fall during athletic activities or on a rainy day.

Recently, all-weather stadiums have been proposed and roofs, for example, a pneumatic film roof structure, for all-weather stadiums have become the object of attention.

However, the pneumatic film roof structure has the following disadvantages.

First, when an athletic stadium has a roof of a pneumatic film structure formed of films of a synthetic resin or the like, the athletic stadium is filled with pressurized air having a pressure slightly higher than the atmospheric pressure, and hence the athletic stadium needs to be sealed so that the pressurized air will not leak outside, which requires entrances and exits of a complicated construction for spectators and the like.

Secondly, such an athletic stadium makes internal lighting and ventilation difficult and spoils the enjoyment of practicing or watching athletic sports in a natural environment.

SUMMARY OF THE INVENTION

Accordingly, it is an object of the present invention to provide a dome-shaped roof structure which is capable of being partly opened according to weather conditions to enabling daylight and ventilation on a fine day so that athletic sports can be practiced in a natural environment or outdoors and for enabling practicing athletic sports in a comfortable condition even on a rainy day, and which is capable of being easily opened and closed.

It is another object of the present invention to provide a method of securely and efficiently constructing such an openable dome-shaped roof structure.

In order to achieve the above objects, the present invention provides an openable dome-shaped roof structure supported on side walls built on the ground, so as to cover an enclosure defined by the side walls, comprising: an anuular stationary roof section having a central opening and fixed along the outer periphery thereof to the side walls; and a movable roof section having a plurality of roof units having substantially the same shape and capable of being radially moved between an open position where the roof units are supported on the stationary roof section and a closed position where the roof units are supported on beams so as to cover the central opening.

The degree of opening of the movable roof section is determined according to the condition of the external environment, such as seasonal conditions and weather conditions, whereby a comfortable internal space may be always provided.

In one embodiment of the present invention, the beams are fixedly extended between the inner periphery of the stationary roof section and the center of the central opening. These fixed beams may include guide rails for guiding the roof units of the movable section.

In another embodiment of the present invention, the beams are movable. When the roof units are at the open position, the movable beams are positioned near the stationary roof section. The movable beams each may be a retractable beam secured to the stationary roof section and extending toward the center of the central opening, the beams being stretched or retracted to shift the roof units. Alternatively, the movable beams each may be a swing beam pivotably joined at one end thereof to the inner periphery of the stationary roof section so as to be turned on a pivot within the central opening.

A method of construction of the stationary roof section of the dome-shaped structure of the invention comprises the steps of: pivotably securing an outer end of each of a plurality of frame members corresponding to radial divisions of the stationary roof section to a fixed annular beam; attaching an arcuate compression beam to an inner end of each frame member; disposing expansion joints between the adjacent compression beams; making up stationary roof units by mounting necessary parts on the frame members, with the inner ends of the frame members being placed on the ground surrounded by a side wall; and lifting up the respective inner ends of the stationary roof units until the roof units are arranged in a predetermined slope where the expansion joints are rigidly fixed. Thus, according to the present invention, since the stationary roof units are assembled substantially on the ground level, they can be assembled safely and only the least possible amount of preparatory work is required. Furthermore, since the roof units of the stationary roof section can be assembled individually, the roof can be efficiently constructed.

The above and other objects, features and advantages of the present invention will become more apparent from the following description of the preferred embodiments thereof when taken in conjunction with the accompanying drawings.

DETAILED DESCRIPTION OF THE INVENTION

Figure 1A:
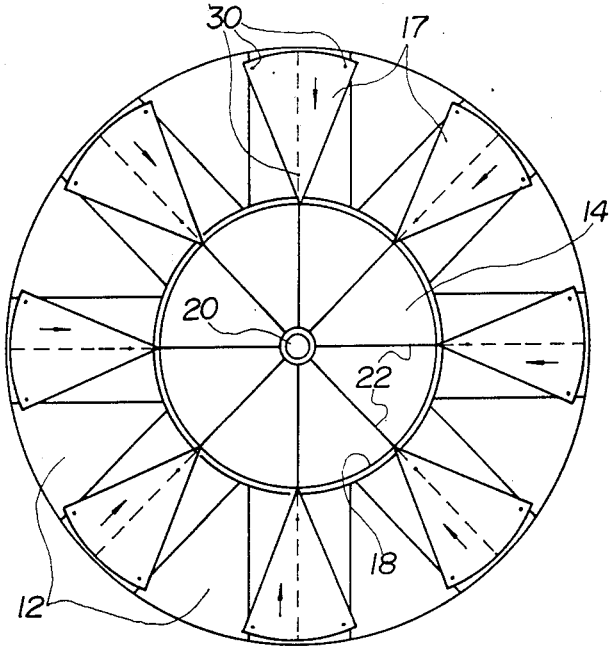
FIGS. 1A and 1B are a plan view and a sectional view, respectively, of an openable dome-shaped roof structure according to a first embodiment of the present invention, in which the roof is an open position.

A first embodiment of the present invention will be described hereinafter with reference to FIGS. 1 through 4.

An openable dome-shaped roof structure shown in these figures is an example as applied to a stadium having a substantially circular configuration and comprising a side wall 10 constructed on the ground in a cylindrical form and stands 11. The openable dome-shaped roof structure is supported on the side wall 10 so as to cover the space defined by the side wall 10. The roof structure comprises an annular stationary roof section 12 which has a substantially circular central opening 14 and is fixed along the outer periphery thereof to the side wall 10, and a movable roof section 16 capable of being radially moved to open or close the central opening 14.

Figure 1B:
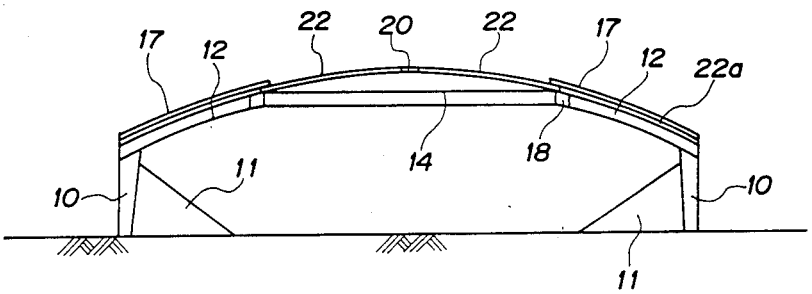
Figure 2A:
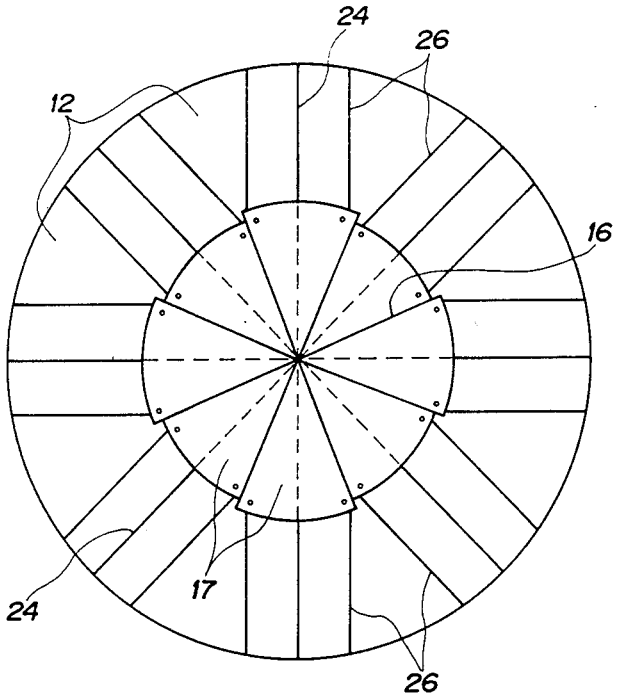
FIGS. 2A and 2B are a plan view and a sectional view, respectively, of the roof structure in a closed position.
Figure 2B:
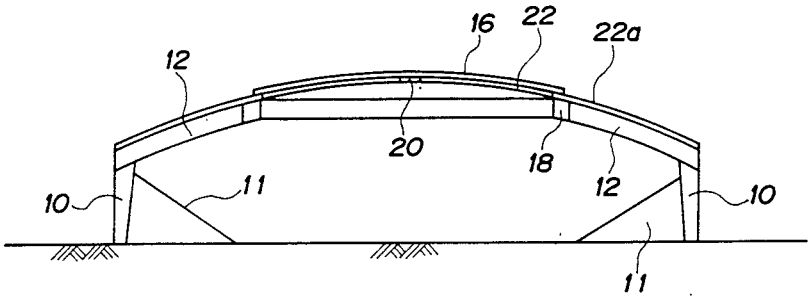

In FIGS. 1A and 1B, the movable roof section 16 is moved radially outward to open the central opening 14, while in FIGS. 2A and 2B, the movable roof section 16 is moved radially inward to close the central opening 14.

As best illustrated in FIG. 2A, the movable roof section 16 comprises eight units 17 each having a substantially fan-shape corresponding to an imaginary sector formed by dividing the central opening 14 of the stationary roof section 12 into eight equal portions at equal angular intervals. A lightweight material, such as a fabric or a very thin metallic plate, is suitable as a roofing material for the roof units 17. When the central opening 14 is closed, the side edges of the adjacent units 17 overlap with each other. The radial length of the units 17 is slightly smaller than the radial width of the fixed roof section 12.

The inner circumference of the stationary roof section 12 is defined by an annular beam 18, which also defines the central opening 14. Eight radial beams 22 are fixed at one end to a beam connecting member 20 placed at the center of the central opening 14 and at the other end to the annular beam 18. Each radial beam 22 has an outer extension 22*a* which reaches the outer periphery of the stationary roof section 12. A main guide rail 24 is fixedly extended on the upper surface of the radial beam 22 over the entire length thereof. A pair of auxiliary guide rails 26 for each roof unit 17 are provided on the stationary roof section 12 in parallel to the main guide rail 24, symmetrically with respect to the main guide rail 24 and with a distance therebetween substantially the same as the width of the roof unit 17.

Spacing members 28 are provided between the stationary roof section 12 and the auxiliary guide rails 26 to adjust the height of the auxiliary guide rails 26 to that of the main guide rail 24.

Figure 3:
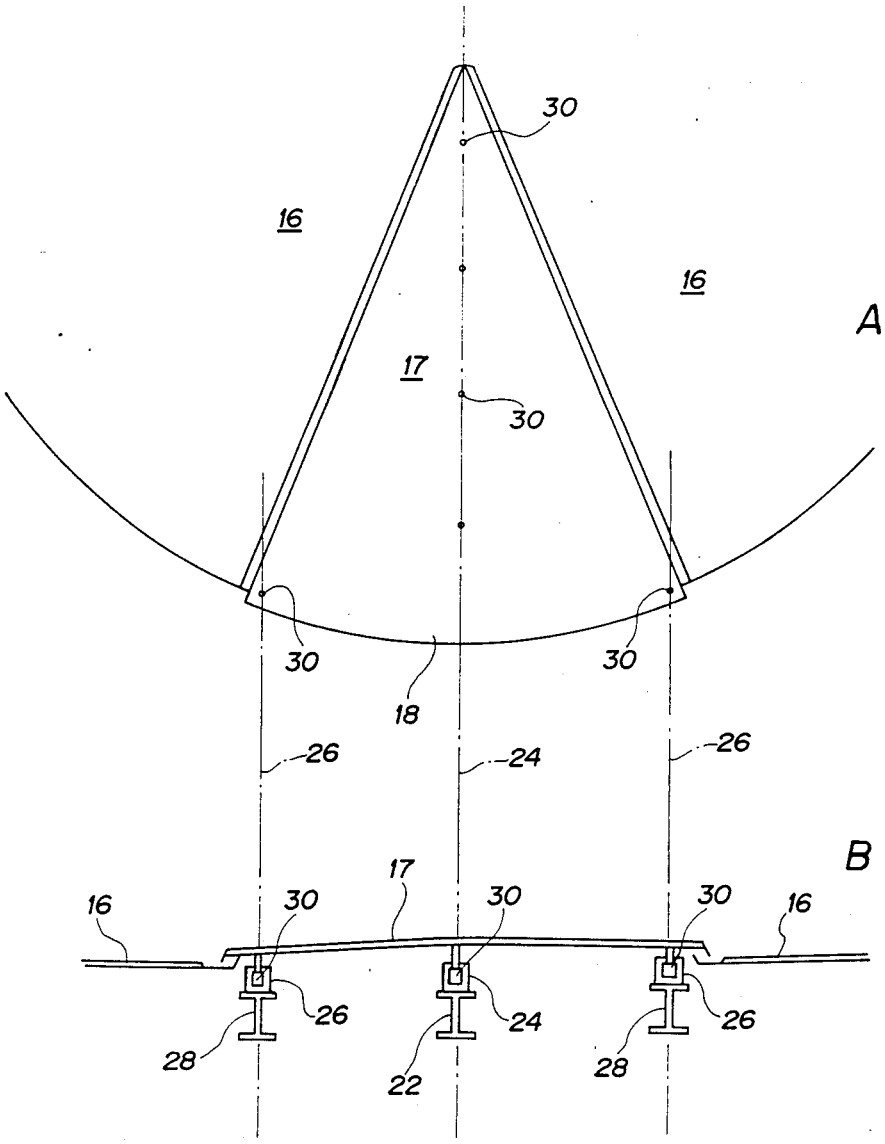
FIGS. 3A and 3B are an enlarged fragmentary plan view and an enlarged sectional view, respectively, showing a movable roof unit of the roof structure.

The positional relation between the roof unit 17, the main guide rail 24 and the auxiliary guide rails 26 is illustrated in detail in FIG. 3.

The main guide rail 24 is in alignment with the center axis of the corresponding roof unit 17, while the pair of auxiliary guide rails 26 coincide with the respective passages of the side corners of the sectorial roof unit 17.

Figure 4:
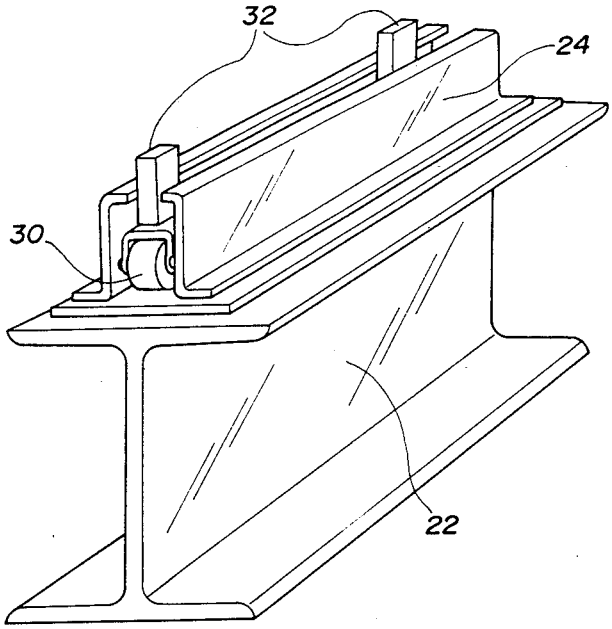
FIG. 4 is an enlarged fragmentary perspective view of a guide rail for the movable roof unit.

As illustrated in FIG. 4, attaching members 32 each provided with a roller 30 are placed on the guide rails 24 (or 26), and each attaching member 32 is to be fixed at the upper end thereof to the backside of the roof unit 17.

The roof unit 17 thus constructed is connected to a wire or a chain which is, in turn, connected to a pneumatically or electrically powered rotary driving source. Thus, the roof unit 17 is moved radially along the main guide rail 24 and the auxiliary guide rails 26 by the driving source to open (FIGS. 1A and 1B) or to close (FIGS. 2A and 2B) the central opening 14 of the stationary roof section 12.

On rainy days and in the summer, the central opening 14 is closed by moving the roof units 17 to the innermost position to complete, in cooperation with the stationary roof unit 12, the dome-shaped roof in order to shield the stadium from rain or the sunshine. On fine days and in intermediate seasons, the roof units 17 of the movable roof section 16 are moved to the outermost position to open the central opening 14 in order to enable athletic sports to be practiced under the sky.

When moved to the outermost position, the roof units 17 of the movable roof section 16 are located on the stationary roof section 12, and hence a particular or special space for receiving the units 17 need not be provided. Further, in case the roof units 17 are designed to have a radial length smaller than the radial width of the stationary section 12, the movable roof section 16 does not project from the outer periphery of the stationary section when the roof units 17 are located at the outermost position, and hence the appearance of the stadium is not spoiled.

Also, the weight of the roof unit 17 can be reduced by using a fabric or a very thin metallic plate, thereby facilitating the movement of units 17.

Furthermore, when the central opening 14 is closed by the movable roof section 16 when using the stadium at night, internal light is reflected by the roof section 16, and thereby the effect of illumination may be enhanced.

Although in the above embodiment the dome-shaped roof is applied to a circular stadium, naturally, the present invention is also applicable to structures having a shape other than a circular shape, such as an elliptic shape or a polygonal shape.

The shape of the central opening 14 need not necessarily be circular but may be elliptic or polygonal. Also, the number of the roof units 17 having substantially the same shape may be an optional number not less than two.

Still further, the roof units 17 of the movable roof section 16 may be moved over the surface of the stationary roof section 12 as in the case of the above-mentioned embodiment, may be moved below the stationary section 12 or may be received in the interior of the stationary section 12.

FIGS. 5A, 5B, 6A, 6B, 7 and 8 show an openable dome-shaped roof structure according to a second embodiment of the present invention. This embodiment is different from the first one in that beams supporting the roof units of a movable roof section are movable. In the second embodiment, each roof unit 17 of the movable roof section 16 is provided at the lower surface with a retractable beam 34 extending along the center axis thereof and with a pair of guide rollers 36 disposed at the opposite side corners thereof. The guide rollers 36 roll along a pair of guide rails 38 which extend in parallel to and symmetrically with respect to the retractable beam 34 and which are spaced from each other at a distance substantially the same as the width of the roof unit 17.

Figure 7:
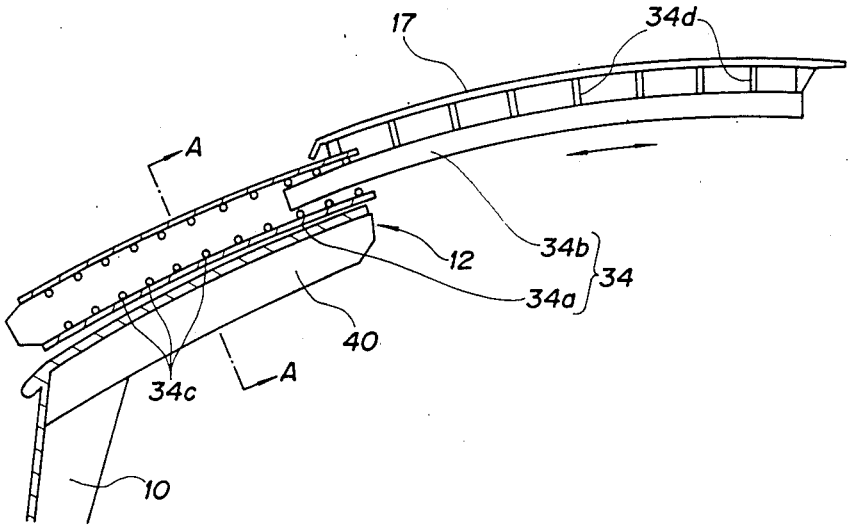
FIG. 7 is a side elevation showing a retractable beam employed in the second embodiment.
Figure 8:
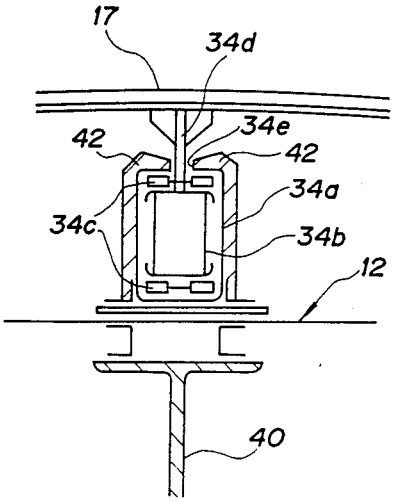
FIG. 8 is a sectional view taken on the line A—A of FIG. 7.

The relative arrangement of the roof unit 17, the retractable beam 34 and the stationary roof section 12 is illustrated in detail in FIGS. 7 and 8.

Basically the retractable beam 34 comprises a hollow outer member **34*a* having a substantially rectangular cross section and an inner member 34*b*. The inner member 34*b* is guided by a plurality of rollers 34*c* that are disposed at regular intervals along the longitudinal direction of the outer member 34*a* and attached to the respective inner surface of the upper and lower walls of the outer member 34*a* so as to be in contact with the upper and lower surfaces of the inner member 34*b* when the inner member 34*b* is retracted into the outer member 34*a*. A plurality of upright legs 34*d* are fixed to the upper surface of the inner beam 34*b* along the longitudinal direction thereof at predetermined regular intervals and project through a guide slit 34*e* formed in the upper wall of the outer member 34*a*. The roof unit 17 is fixed to the upper ends of the legs 34*d* so that the roof unit 17 and the outer member 34*a*** are spaced from each other by a predetermined distance.

On the other hand, the outer member **34*a* of the retractable beam 34 extends along a support 40 of the stationary roof section 12 and is fixed to the stationary section 12 with a reinforcement 42** therebetween.

Figure 5A:
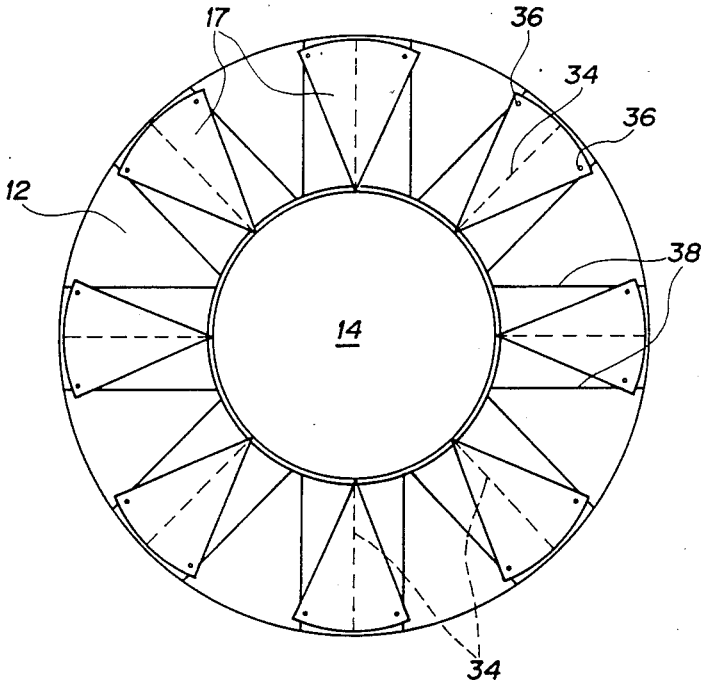
FIGS. 5A and 5B are a plan view and a sectional view, respectively, showing an openable dome-shaped roof structure according to a second embodiment of the present invention, in which the roof is in an open position.
Figure 5B:
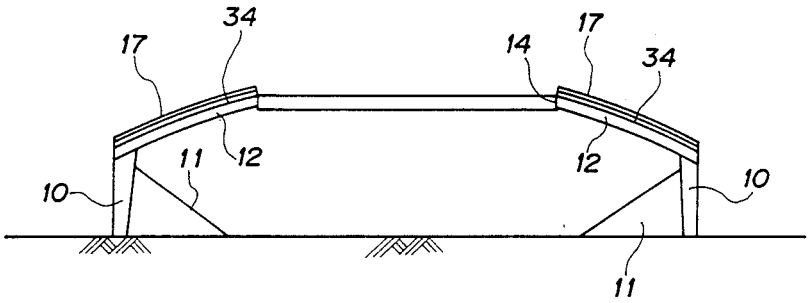
Figure 6A:
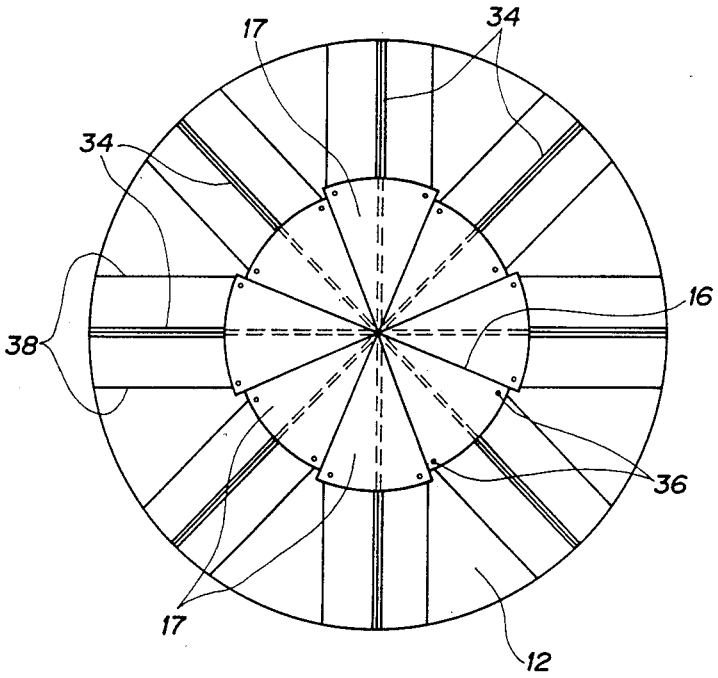
FIGS. 6A and 6B are a plan view and a sectional view, respectively, of the second embodiment in which the roof is in a closed position.
Figure 6B:
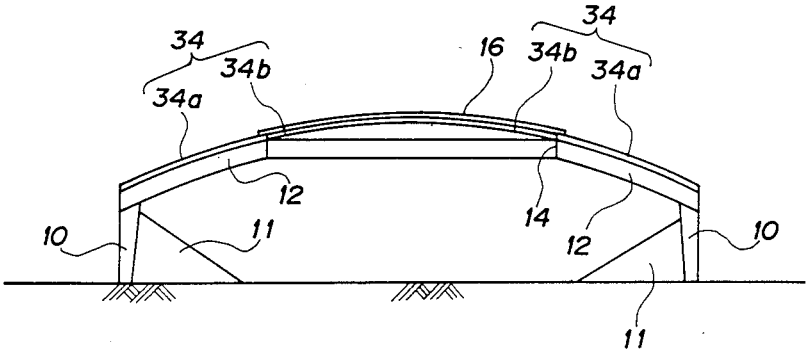

The inner member **34*b* is connected to a steel wire or a chain which is, in turn, connected to a rotary driving surce, such as a pneumatic or electric motor. The inner member 34*b* is moved relative to the outer member 34*a* in directions indicated by a dounble-headed arrow in FIG. 7 by the driving source. When the inner members 34*b* are projected from the outer members 34*a* to the outermost position, the roof units 17 cover the central opening 14. When the inner members 34*b* are fully retracted into the outer members 34*a*, the roof units 17 are located over the stationary roof section 12 to open the central opening 14 as illustrated in FIGS. 5A and 5B. In the latter position, nothing exists in the central opening 14, and hence the second embodiment is more effective than the first embodiment a giving free and open feeling to the persons in the stadium. Since the movable roof section can be easily shifted by propelling or rectracting the beams 34**, the second embodiment is able to quickly cope with rapid variations of the environmental conditions.

Figure 9:
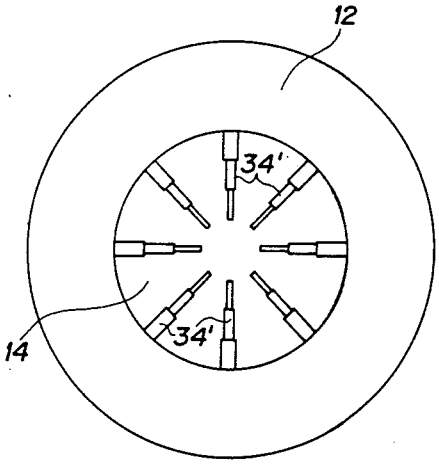
FIG. 9 is a schematic plan view showing a modification of the retractable beam.

In practical application, various retractable beams of different constructions other than that employed in the second embodiment are applicable to the roof structure of the present invention. For example, a retractable beam 34' as schematically illustrated in FIG. 9, consisting of a plurality of sectional parts that fit one within another and designed so as to be stretched or contracted by built-in jack means, may be incorporated into the openable roof structure.

Figure 10:
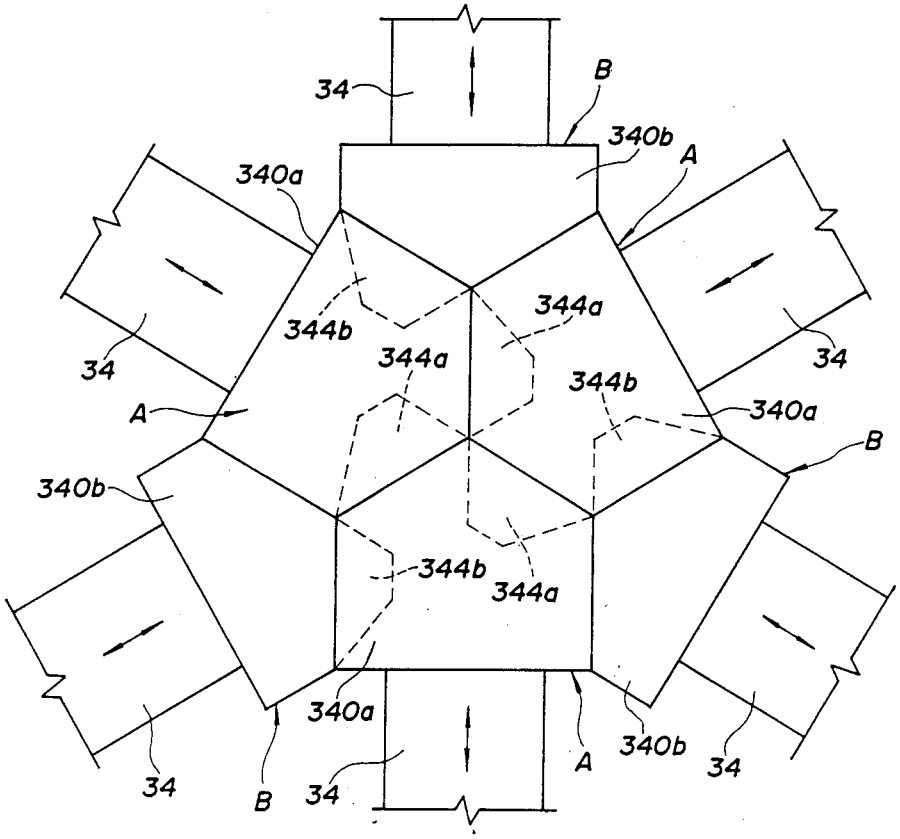
FIG. 10 is an enlarged plan view illustrating free ends of the retractable beams in FIG. 9, in which the beams are joined together at the free ends.
Figure 11:
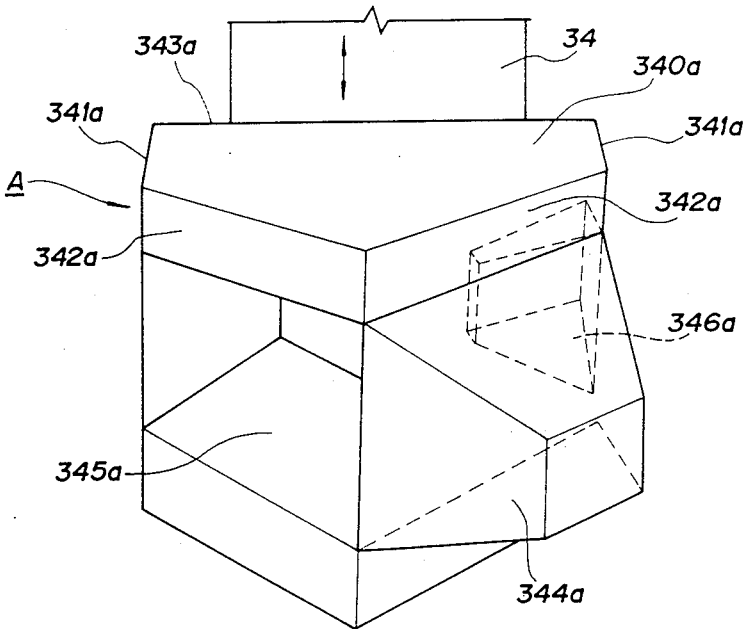
FIGS. 11 and 12 are perspective views of the complementary free ends of retractable beams, respectively.
Figure 12:
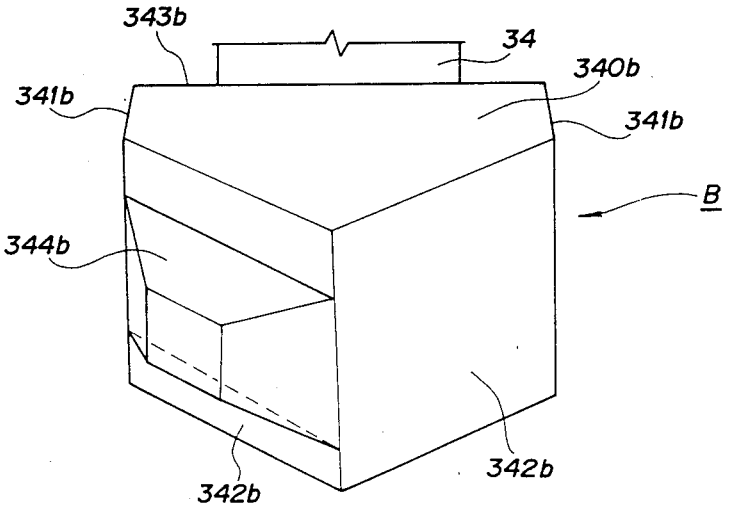

Incidentally, when a movable beam, such as the retractable beam, supporting the roof unit 17 of the movable roof section 16 is attached only at one end thereof to the stationary roof section, the movable beam is not necessarily strong enough to withstand stormy weather conditions such as strong wind. Therefore, it is preferable to interlock the respective free ends of the movable beams with each other when the movable beams are fully extended, in order to enhance the supporting strength of the movable beams so that the roof units are supported securely. An example of an interlocking structure of the movable beams is illustrated in FIGS. 10, 11 and 12, in which six retractable beams, by way of example, are to interlock with each other. The beams 34 are divided into two groups, group A and group B and are disposed in an alternate arrangement of the group A and group B. The beams 34 in each group have substantially the same free end or head.

FIG. 11 illustrates an interlocking head **340*a* of the retractable beam 34 in the group A. The interlocking head 340*a* has the shape of a pentagonal prism having substantially parallel upper and lower surfaces, a pair of parallel side surfaces 341*a*, a pair of oblique side surfaces 342*a* and a base surface 343*a* interconnecting the parallel side surfaces 341*a*. The retractable beam 34 extends from the base surface 343*a* toward the stationary section 12**.

A first tapered projection **344*a* projects from the middle portion of one of the oblique side surfaces 342*a*, while a first recess 345*a* tapering toward the bottom is formed in the other oblique side surface 342*a* so as to engage with the first tapered projection 344*a* of the adjacent interlocking head 340*a***.

A second recess **346*a* tapering toward the bottom is formed in one of the parallel side surfaces 341*a* adjacent to the oblique side surface 342*a* having the first projection 344*a***, so as to engage with a projection formed in an interlocking head of the retractable beam in the group B disposed next to the retractable beam in the group A with respect to a clockwise direction.

FIG. 12 illustrates an interlocking head **340*b* of the retractable beams 34 in the group B. The interlocking head 340*b* has, similarly to the interlocking head 340*a* of group A, the shape of a pentagonal prism having a pair of parallel side surfaces 341*b*, a pair of oblique side surfaces 342*b* and a base surface 343*b*. The retractable beam 34 of the group B extends from the base surface 343*b*. A second projection 344*b* which engages with the second recess 346*a* is formed in one of the oblique side surfaces 342*b***.

The interlocking heads 340*a* and 340*b* of the retractable beams 34 interlock each other in the following manner.

First, the beams 34 of the group A are stretched toward the center of the central opening 14 to engage the corresponding first projections 344*a* with the first recesses 345*a* of the interlocking heads 340*a* and to bring the opposite oblique side surfaces 342*a* of the adjacent interlocking heads 340*a* into contact with each other.

Secondly, the beams 34 of the group B are stretched toward the center of the central opening 14 to engage the second recesses 346*a* of the interlocking heads 340*a* of the group A with the second projections 344*b* of the interlocking heads 340*b* of the group B, and to bring the oblique side surfaces 342*b* of the interlocking heads 340*b* into contact with the parallel side surfaces 341*a* of the adjacent interlocking heads 340*a* of the group A.

In disengaging the interlocking heads 340*a* and 340*b*, first the beams 34 of the group B are retracted, and then the beams 34 of the group A are retracted.

A swing beam is another typical example of a movable beam for supporting the roof unit 17 of the movable roof section 16. A preferred arrangement of such swing beams is shown in FIGS. 13 through 16. This arrangement includes, by way of example, eight swing beams 50*a* to 50*h* each pivotably joined at one end to the annular beam 18 of the stationary roof section 12 at points $P_1$ to $P_8$ which are distributed on the annular beam 18 at regular angular intervals, so that these beams 50*a* to 50*h* are swingable in a horizontal plane.

Figure 13:
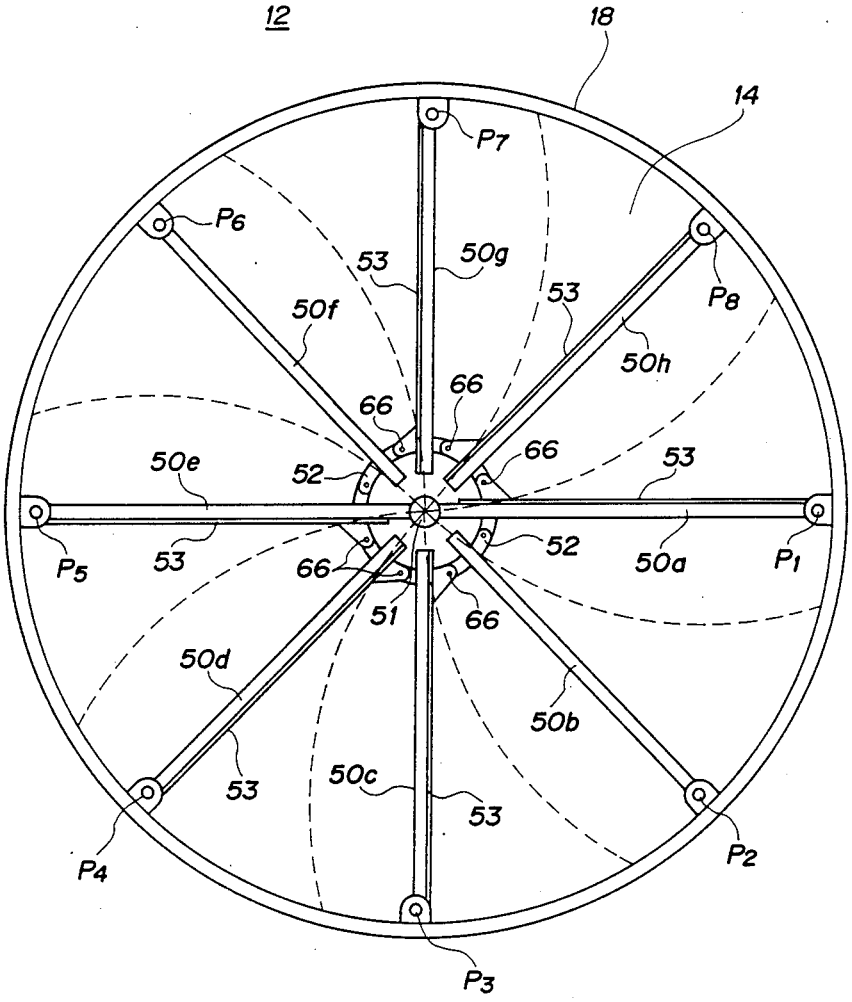
FIG. 13 is a plan view of exemplary swing beams.
Figure 14:
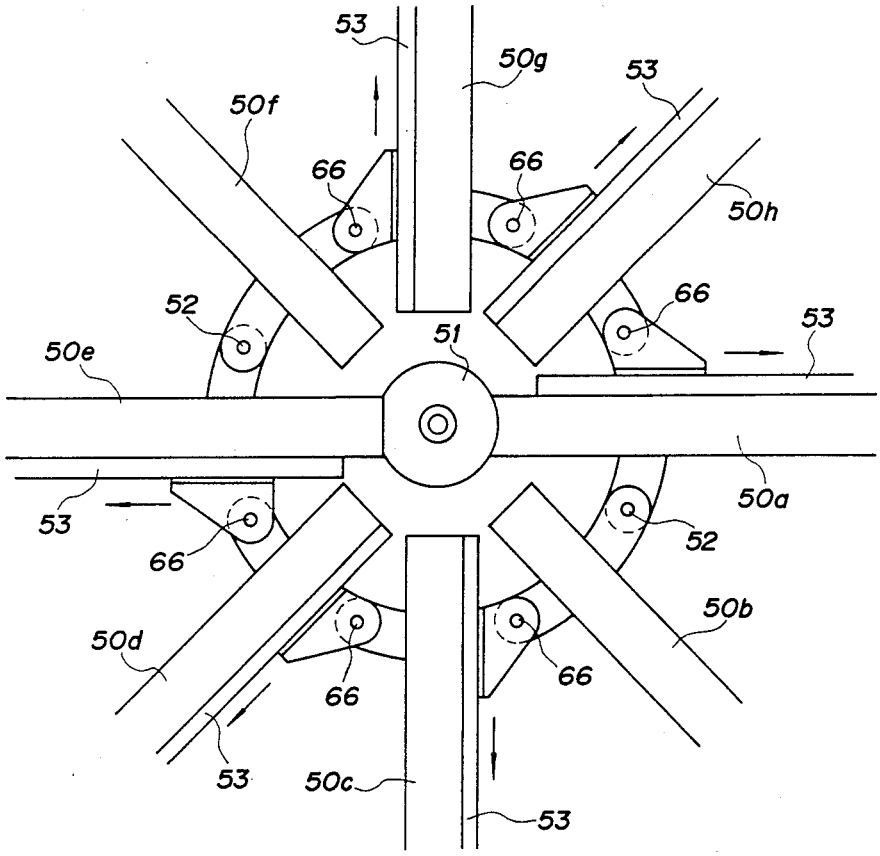
FIG. 14 is an enlarged plan view of the swing beams of FIG. 13.

When the central opening 14 is closed with the roof units 17 as shown in FIG. 13, the swing beams 50*a* to 50*h* extend radially outward from the center of the central opening 14 and, as illustrated in FIG. 14, the diametrically opposite swing beams 50*a* and 50*e* are detachably and linearly joined together by a link device 51. The swing beam 50*a* and the circumferentially adjacent swing beam 50*b* in a clockwise direction are joined together by a circumferential link device 52. Similarly, a swing beams 50*e* and 50*f* are joined together by the device 52. These link devices 51 and 52 have a mechanism adapted to engage or disengage the respective swing beams by using a pin or solenoid to be controlled by a switch.

The circumferentially adjacent swing beams are paired, that is, the swing beams 50*b* and 50*c*, 50*c* and 50*d*, 50*d* and 50*e*, 50*e* and 50*f*, 50*f* and 50*g*, 50*g* and 50*h*, and 50*h* and 50*a* are paired with each other. One of the swing beams in each pair is slidably and pivotably connected to the side of the other swing beam, as shown in detail in FIG. 15.

Figure 15A:
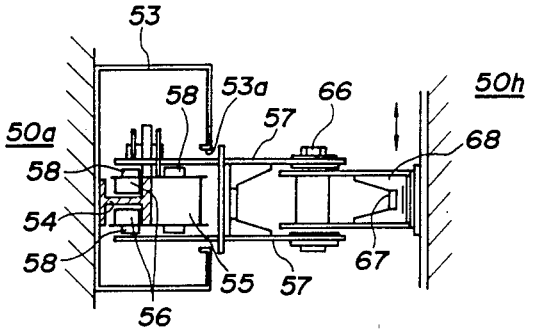
FIGS. 15A, 15B and 15C are a sectional view, a side elevation and a plan view, respectively, of a sliding-pivot mechanism of the swing beams.
Figure 15B:
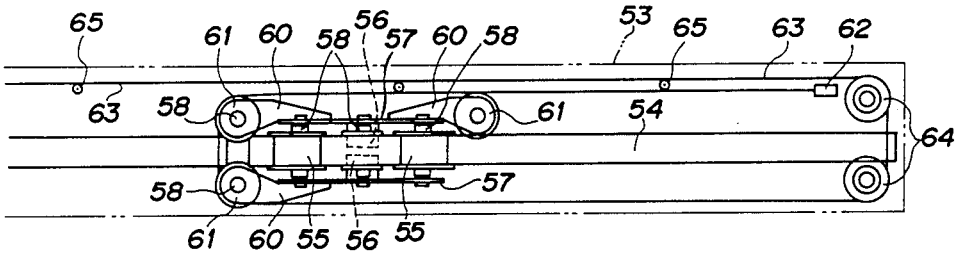
Figure 15C:
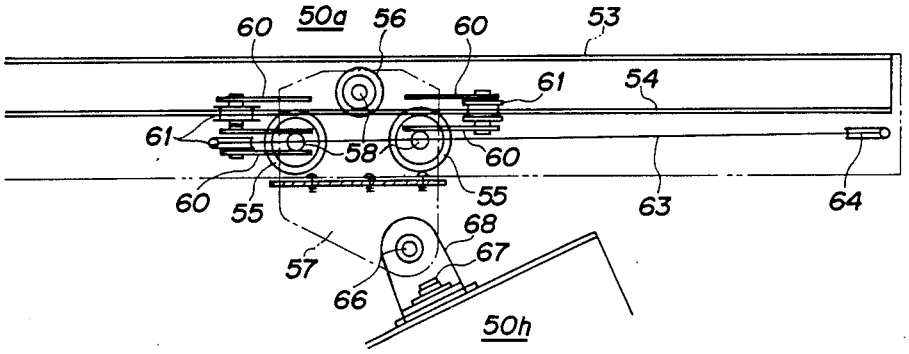

The mechanism for slidably and pivotably connecting the swing beam 50*h* to the beam 50*a*, for instance, is shown in FIGS. 15A to 15C. The swing beam 50*a* is fixedly provided on one side wall thereof facing the swing beam 50*h* with a frame 53 having a longitudinal slit 53*a* and extending from the free end of the swing beam 50*a* to a position near the point $P_1$ at the annular beam 18, within which frame 53 a guide rail 54 having an I-shaped cross section extends longitudinally over the entire length thereof. A pair of larger rollers 55 and a pair of smaller rollers 56 are provided so as to roll along the opposite surfaces of the flange of the guide rail 54, respectively. The rollers 55 and 56 are pivotably supported by spindles 58 on a pair of holding plates 57 extending through the slit 53*a* outside the frame 53.

Three rotary sheaves 61 are supported by spindles 58 on supporting arms 60 attached to the outer surfaces of the holding plates 57, respectively, so as to roll along the side surfaces of the flange of the guide rail 54. A wire 63 fixed at one end thereof to the frame 53 by an anchor 62, is wound around the sheaves 61 and sheaves 64 which are mounted on the free end of the frame 53. The other end of wire 63 extends, via small sheaves 65 disposed at suitable intervals within the frame 53, toward the pivoted end or base of the swing beam 50*a*.

A connecting arm 68 fastened by a bolt 67 to the swing beam 50*h* at a position near the free end thereof, is pivotably joined to the outer end of the holding plates 57 by means of a connecting pin 66. The connecting arm 68 may be joined to the swing beam 50*h* by, for example, a dovetail joint so as to be slidable perpendicularly to the swing beam 50*h*.

Figure 16A:
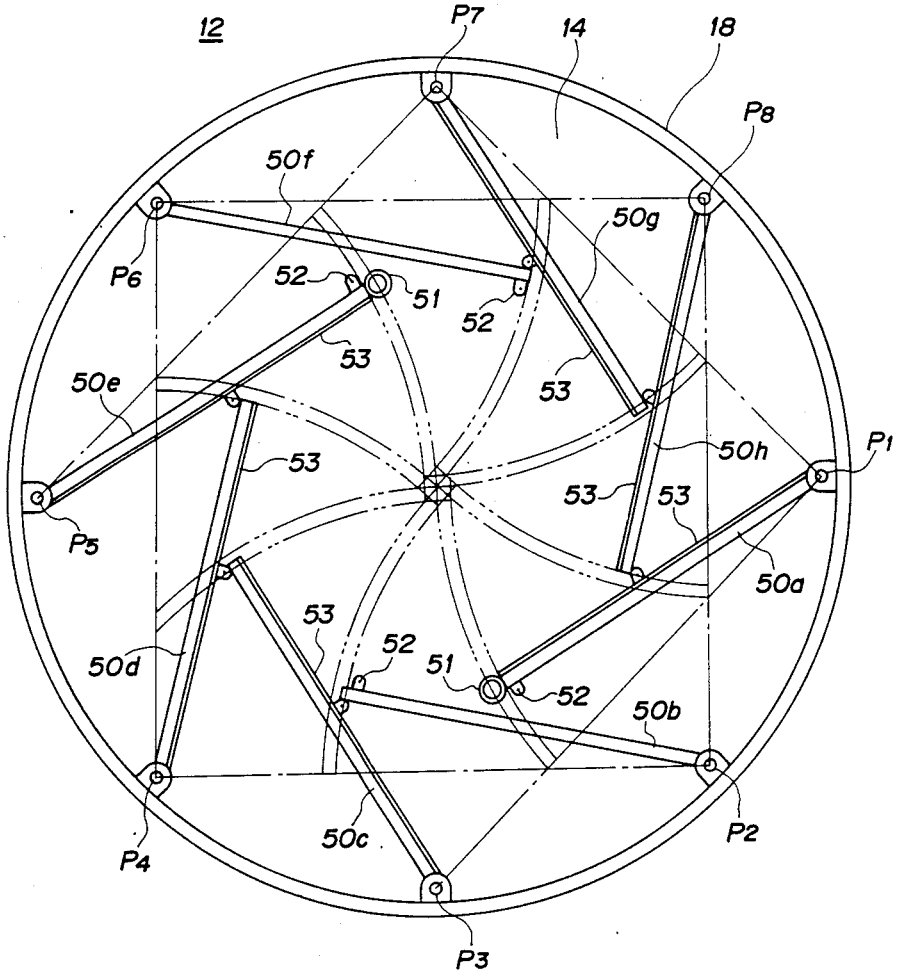
FIGS. 16A and 16B are plan views of the swing beams during swing motion and at the completion of the swing motion, respectively.
Figure 16B:
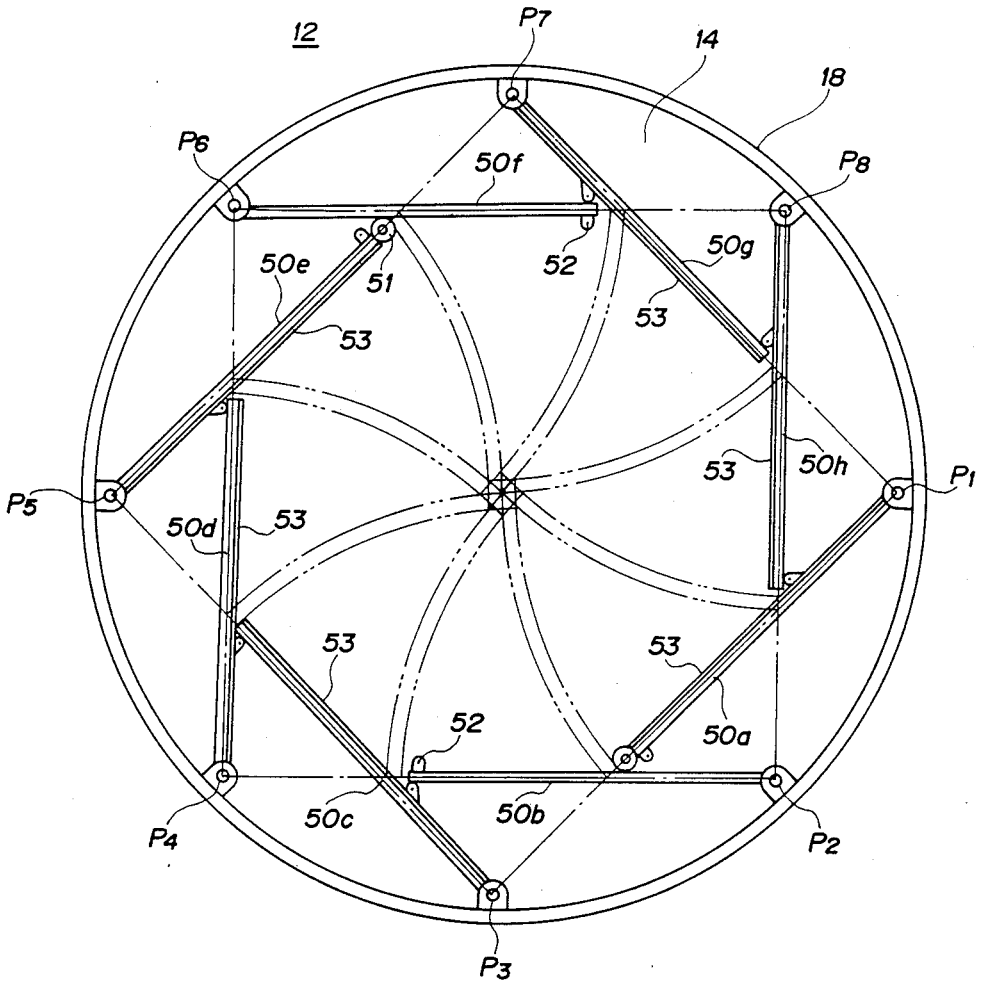

When the wires 63 are pulled by a winch or the like after disengaging the link devices 51 and 52 by suitable means with the swing beams in a position as shown in FIG. 13, a set of the four interconnected swing beams 50*b*, 50*c*, 50*d* and 50*e* and a set of the four interconnected swing beams 50*f*, 50*g*, 50*h* and 50*a* turn about the pivotal points $P_1$ to $P_8$ on the annular beam 18 within a plane containing the central opening 14. Consequently, as is best seen from FIG. 16A showing the swing beams in the process of opening swing motion and FIG. 16B showing the disposition of the swing beams at the completion of the opening motion thereof, a substantially octagonal space defined by the beams 50*a* to 50*h* and within the central opening 14 expands gradually. Upon the alignment of the swing beams 50*a* to 50*h* with axes passing through alternate pivotal points $P_1$ to $P_8$ on the annular beam 18, the swing motion of the beams 50*a* to 50*h* is terminated.

When the wires 63 are loosened, the swing beams 50*a* to 50*h* turn in the opposite direction to return to the position shown in FIG. 13 in which they extend radially from the center of the opening 14.

Each swing beam is provided with guide means, not shown, such as a guide rail, for movably supporting the roof unit 17 of the movable roof section 16. In this case, guide members similar to those shown in FIG. 6 may be provided on the stationary roof section 12.

Figure 17:
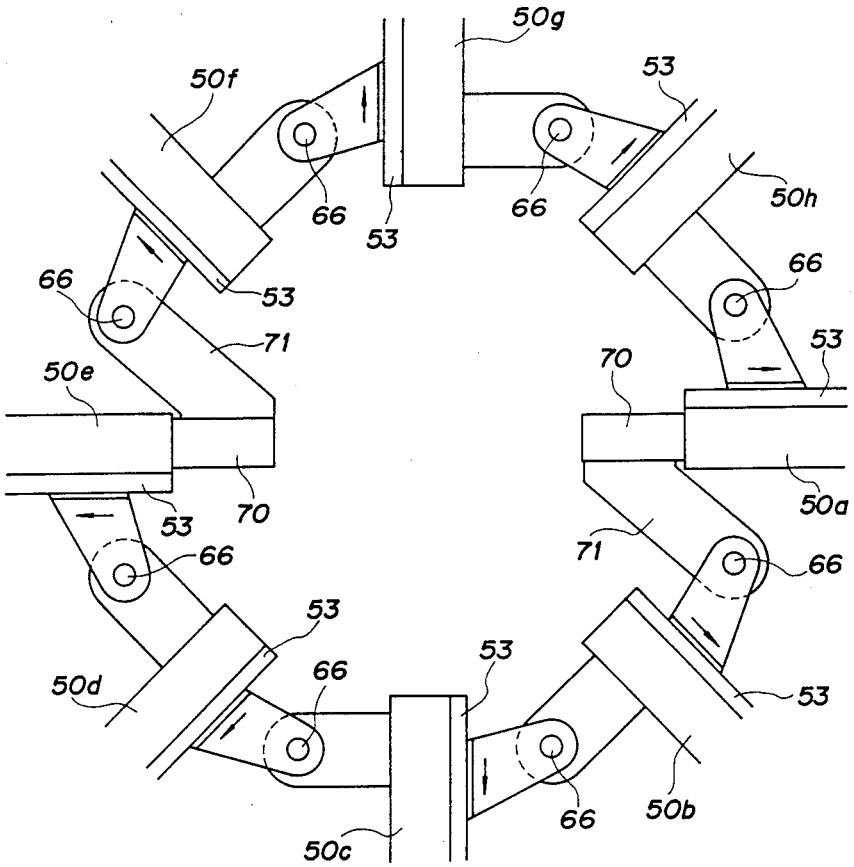
FIG. 17 is an enlarged fragmentary view showing another example of swing beams.
Figure 18:
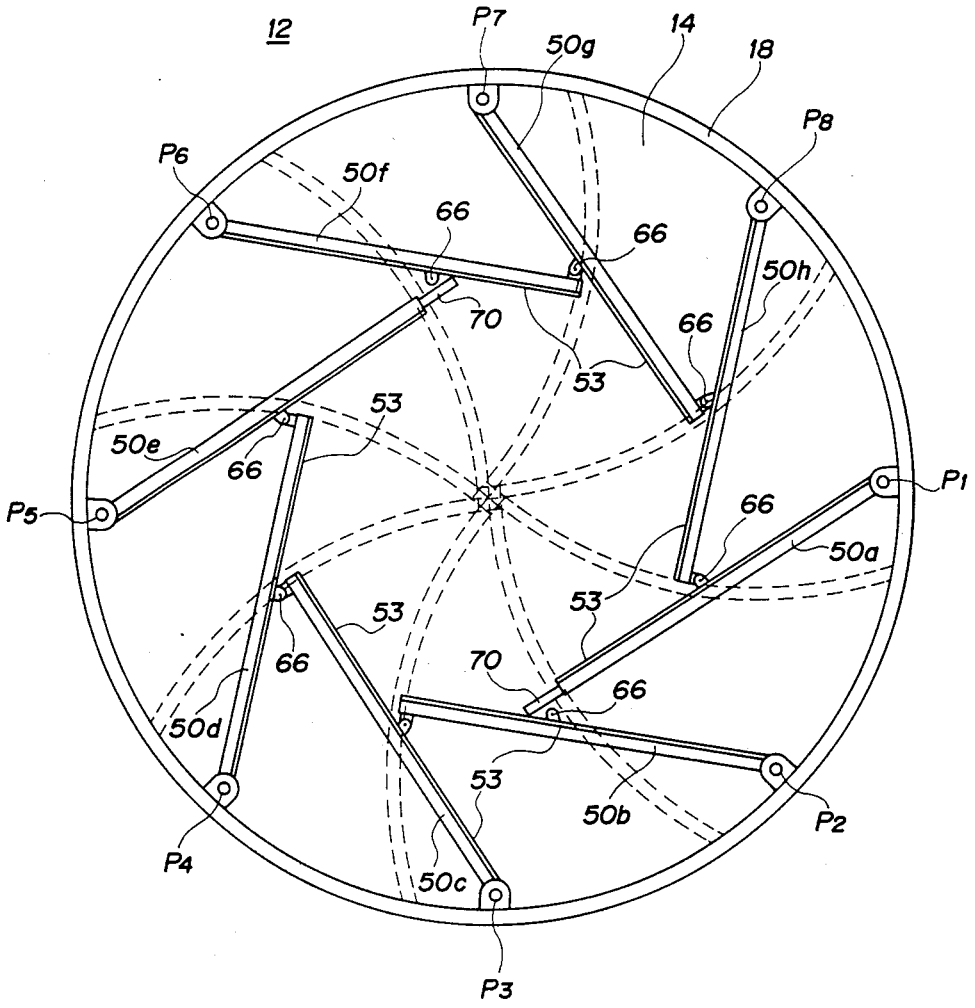
FIG. 18 is a plan view illustrating the swing motion of the swing beams of FIG. 17.

FIGS. 17 and 18 show a swing beam mechanism in a modification of the above-mentioned structure. The modified swing beam mechanism will be described only with regard to features thereof different from the above-mentioned embodiment to avoid duplication. Retractable members 70 are built in the swing beams 50*a* and 50*e*, respectively, instead of the link device 51 provided between the swing beams 50*a* and 50*e*, and instead of the link devices 52 provided between the beams 50*a* and 50*b* and between the swing beams 50*e* and 50*f*. Brackets 71 are provided on the respective free ends of the retractable members 70. Slidable joining mechanisms each including a frame 53 are provided on the side walls of the swing beams 50*b* and 50*f*, respectively. The connecting plates 57 of the slidable joining mechanisms are pivotably connected to the brackets 71 by pins 66, respectively.

Thus, in this modified swing beam mechanism, the two diametrically opposite swing beams 50*a* and 50*e* are internally provided with the retractable members 70 and all the swing beams 50*a* to 50*h* are connected pivotably one to another for relative sliding motion.

As shown in FIG. 18, all the swing beams 50*a* to 50*h* are always connected to the adjacent swing beams as they are turned on the pivotal points with the retractable members 70 retracting or extending, to expand or to contract a substantially octagonal space in the central area of the opening 14. Since all the swing beams 50*a* to 50*h* swing in an integral linkage to open or to close the central opening 14, this modified swing beam mechanism is more stable and more advantageous with respect to structural reliability than the swing beam mechanism of the preceding embodiment.

The slidable joining mechanism need not necessarily include the rollers 55 and 56 and the wire 63, but may include a driving shaft extended within the frame 53 and a wormgear for transmitting the rotary driving force of the driving shaft to the adjacent swing beam, or include a chain and sprockets.

Figure 19A:
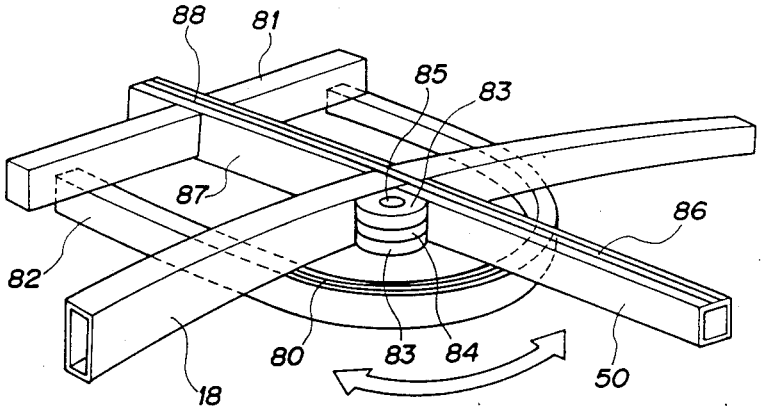
FIG. 19A is a perspective view of a swing beam supporting mechanism.

When the above-mentioned swing beam is employed for supporting the roof unit 17 of the movable roof section 16, it is preferable to provide a semicircular guide member as shown in FIG. 19A around the base end of the swing beam for ensuring stable motion of the swing beam. The guide member shown in FIG. 19A is a semicircular guide rail 80 properly protruding, for guiding the swing motion of the beam 50 from the inner surface of the annular beam 18. The guide rail 80 is provided on a substantially U-shaped guide rail supporting frame 82 fixed to the annular beam 18 and a girder 81 of the stationary roof section 12. The guide rail 80 supports and guides the swing beam 50 for sliding-swing motion through an angle of 90 degrees between a position where the swing beam 50 is located near the annular beam 18 and a position where the same is located substantially at right angles to the annular beam 18. In order to reduce the frictional resistance of the sliding surface of the guide rail 80 to the least possible extent, the sliding surface of the guide rail 80 is formed of a material having a small coefficient of friction, such as a polytetrafluoroethylene.

In FIG. 19A, indicated at 83 and 84 are knuckles fixed to the annular beam 18 and the swing beam 50, respectively. The swing beam 50 is pivotably joined to the annular beam 18 by joining the knuckles 83 and 84 with a pin 85. Indicated at 86 is a guide rail extending on the upper surface of the swing beam 50. The guide rail 86 is continuous with a guide rail 88 extending on the upper surface of a radial girder 87 of the stationary roof section 12. The guide rails 86 and 88 guide the roof unit 17 of the movable roof section 16 for sliding movement.

The swing beam 50 is driven for sliding-swing motion along the guide rail 80 by suitable driving means. When the central opening 14 is fully opened, the outer end of the swing beam 50 comes into abutment with the inner surface of the annular beam 18. During the swing motion of the beam 50, the load is not concentrated only on the pin 85, but is distributed to the pin 85 and the guide rail supporting frame 82. Therefore, the swing beam 50 is supported rigidly, bending of the swing beam 50 is reduced and the swing beam 50 is able to swing stably and safely.

The swing beam 50 can be automatically and correctly located at a position as illustrated in FIG. 19A by providing a stopper at an appropriate position on the guide rail 80 and by making the outer end surface of the swing beam 50 come into abutment with the inner surface of the annular beam 18.

Figure 19B:
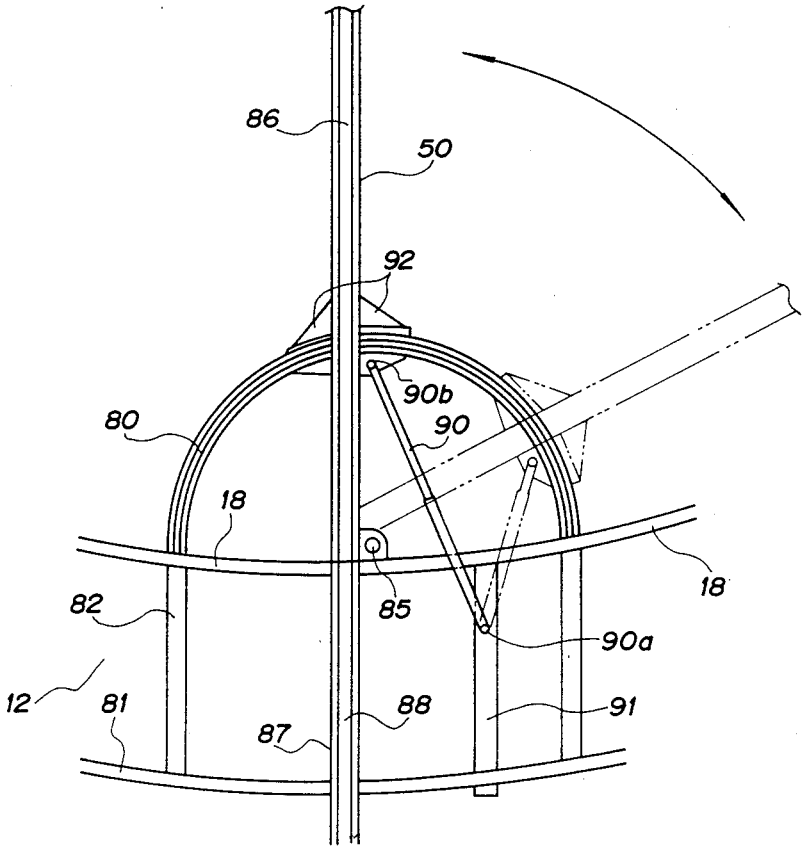
FIG. 19B is a plan view showing an example of a swing beam driving mechanism.

An exemplary driving means for driving the swing beam 50 for sliding-swing movement is shown in FIG. 19B. The driving means comprises a hydraulic jack 90. The base end 90*a* of a cylinder of the hydraulic jack 90 is joined pivotably to a strut 91 extending between the annular beam 18 and the girder 81 of the stationary roof section 12, while the free end 90*b* of a piston rod is connected to the swing beam 50 at a predetermined position by a connecting member 92. The hydraulic jack 90 is extended or contracted to turn the swing beam 50 along the guide rail 80. The driving means for driving the swing beam 50 need not necessarily be limited to the hydraulic jack but may be any suitable means such as a device including a wire for controlling the swing beam 50.

In the embodiment shown in FIGS. 19A and 19B, the swing beam 50 is driven individually for swing motion, which is different from the proceding embodiments. Preferably, the swing beam 50 is retractable and is extended after being turned to a position indicated by continuous lines in FIG. 19B to engage interlocking heads of the adjacent swing beams for ensuring sufficient strength to support the units 17.

A construction method according to the present invention will be described hereinafter. The method is mainly directed to the construction of the stationary roof section of the above-described openable dome-shaped roof structure. The processes of a preferred embodiment of the method are shown in FIGS. 20, 21 and 22.

Figure 20:
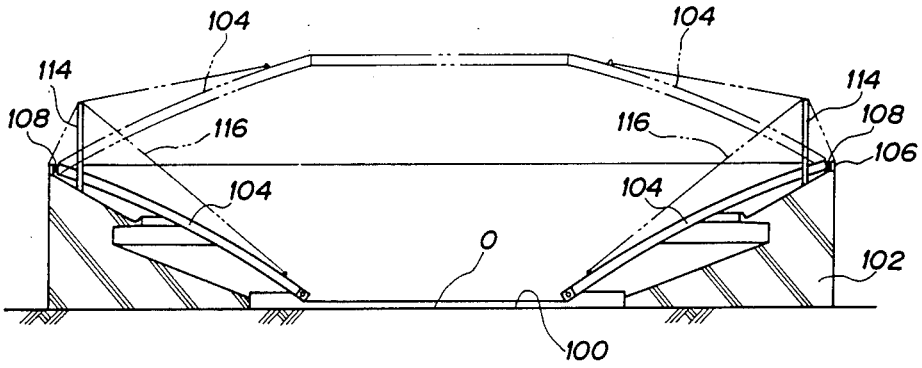
FIGS. 20, 21 and 22 are a sectional view, an enlarged fragmentary plan view and a plan view, respectively, of assistance in explaining a construction method according to an embodiment of the present invention, in which in FIG. 22 the construction is completed.
Figure 21:
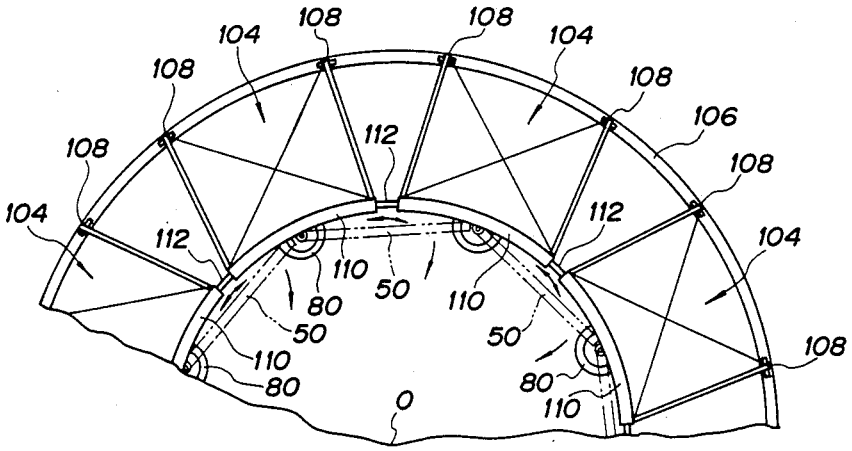
Figure 22:
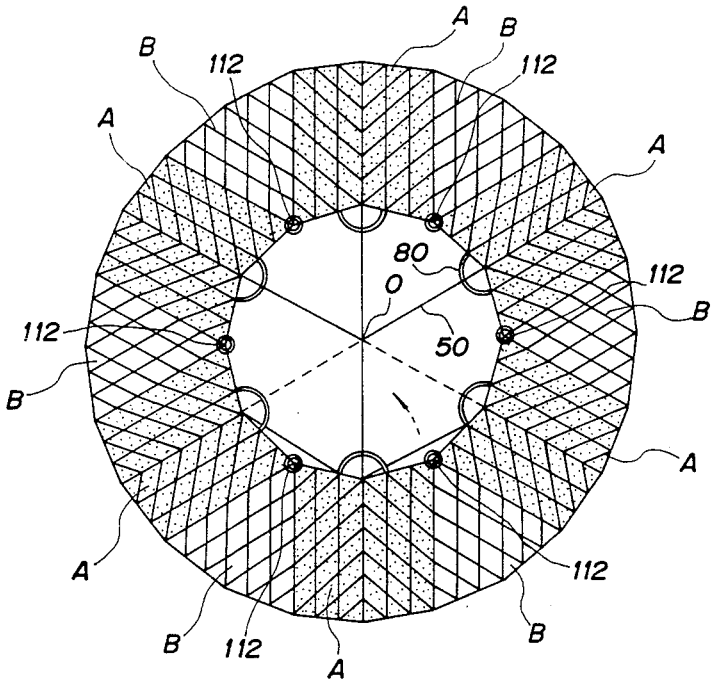

Referring to FIGS. 20 to 22, indicated at 100 is the ground of an athletic stadium such as a baseball field, and numeral 102 denotes a practically circular structure constructed around the ground 100. The structure 102 has an external wall (a side wall) and stands declining in steps from the external wall toward the ground 100. The above-mentioned stationary roof section 12 is built on the external wall.

The stationary roof section comprises a plurality of frame members 104 arranged around the center O of the structure 102. An outer or base end of each frame member 104 is secured pivotably with a pin 108 on a fixed annular beam 106 fixedly disposed along the upper end of the external wall of the structure 102. An arcuate compression beam 110 is attached to each frame member 104 to define the inner side, namely, the side facing the central opening.

The adjacent compression beams 110 are joined together by hydraulic or mechanical expansion joints 112, respectively. The base end of swing beam 50 is pivotably secured to the compression beam 110 at the middle of the inner surface thereof so as to be swingable along the semicircular guide rail 80 fixed to the inner surface of the compression beam 110. Although the openable dome-shaped roof structure is explained herein as employing the swing beams for the sake of convenience, naturally, the roof structure may employ any one of the above-mentioned movable beams or fixed beams.

A temporary post 114 is set up for every frame member 104 at a position near the outer end thereof. A tension member 116 having one end connected to the inner side of the frame 104 is extended over the top of the temporary post 114.

Each frame 104 is assembled with the outer side being supported on the annular beam 106 by the pin 108 and the inner side being placed on the ground 100. After the frame 104 has been assembled, the components of a roofing structure, such as struts, principal rafters, purlins and common rafters, and roofing plates or films are assembled on the frame 104 to complete a roof unit for the stationary roof section 12.

After all stationary roof units have been completed, the tension members 116 are wound to turn the frames (stationary roof units) 104 about the corresponding pins 108 so that the respective inner sides of the units 104 are lifted up. As the units 104 are turned upward, the clearances between the adjacent compression beams 110 are decreased, which is absorbed by the contraction of the expansion joints 112. The clearances decrease until the units 104 are turned to a horizontal position, and then increase again as the units 104 are turned further upward. After the units 104 have been disposed at a predetermined pitch, the expansion joints are fastened rigidly to complete a stationary roof section having a central opening. Thereafter, the swing beams 50 are turned until the free ends thereof are interlocked at the center O of the central opening to complete the dome-shaped roof structure as illustrated in FIG. 22.

In FIG. 22, areas A shaded with dots correspond to the roofing extended over the roof units 104. Triangular areas B between the adjacent areas A may be roofed by extending the roofing over the units 104 or may be roofed separately after fixing the units 104 in place. The temporary posts may be removed after the stationary roof section has been completed or may be reserved for use as supports or as maintenance facilities.

Figure 23:
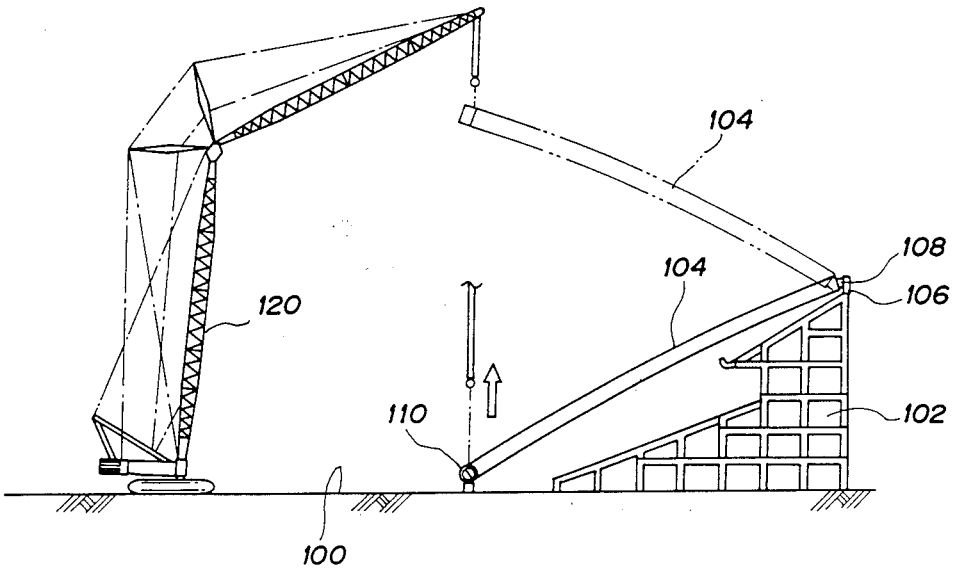
FIG. 23 is an illustration of assistance in explaining a construction method according to another embodiment of the present invention.

Another method according to the present invention is shown in FIG. 23. In this embodiment, the stationary roof units 104 are lifted up by a crane 120 installed on the ground 100. The use of a lifting machine in combination with the crane 120 will enable the units 104 to be lifted up more securely.

According to the embodiments described hereinbefore, the stationary roof units are assembled with the annular beam 106 being fixed on the external wall, however, the annular beam 106 need not necessarily be secured to the external wall in advance but it is also possible to lift up the annular beam 106 onto the external wall and to fix the same at a predetermined position after assembling the stationary roof section entirely on the ground.

As is apparent from the foregoing description, according to the present invention, the processes of constructing the frame members and finishing the roof units are carried out practically on the ground level with the frames being supported on the ground, and hence large-scale timbering including temporary standards is unnecessary and temporary operations including the construction of scaffoldings and prevention of danger can be reduced greatly. Furthermore, the reduction of construction work at an elevated level effectively reduces labor. Since the method according to the present invention greatly reduces preparatory operations including timbering, the work for constructing the roof structure can be started at an early time. Still further, since the plural frame members and roof units can be simultaneously fabricated, the period necessary for the construction work can be curtailed. Moreover, assembling the stationary roof units practically on the ground level facilitates inspection and eliminates the danger of work at an elevated level. The combined effect of the above-mentioned advantages reduces the construction cost, and hence the method according to the present invention is particularly suitable for an openable dome-shaped roof structure which, in general, is costly.

We claim:

1. An openable dome-shaped roof structure for covering an enclosure defined by a side wall constructed on the ground, said roof structure comprising:

an annular stationary roof section having a central opening and fixedly secured along an outer periphery thereof to said side wall;

a movable roof section comprising a plurality of roof units having substantially the same shape and corresponding to the shape of each of a plurality of equal divisions of said central opening, each of said roof units being radially movable between an open position where said roof unit is supported on said stationary roof section, and a closed position where said roof unit is supported in said central opening; and a plurality of retractable beams for supporting respective said roof units in said central opening, each said retractable beam being connected to said stationary roof section and extending toward the center of said central opening, each said retractable beam being provided at the inner end thereof with an interlocking head, and said interlocking heads of adjacent of said retractable beams engaging with each other at the center of said central opening when said retractable beams are fully extended.

2. An openable dome-shaped roof structure as claimed in claim 1, wherein said interlocking heads of said retractable beams are alternately classified into a first group and a second group, each of said interlocking heads of said first group has a recess and a projection for engagement with adjacent interlocking heads of said first group and has a depression for engagement with an adjacent interlocking head of said second group, each of said interlocking heads of said second group has a projection engagable with said depression, and all said interlocking heads are engaged with each other by first engaging said interlocking heads of said first group with each other and then engaging said interlocking heads of said second group with said interlocking heads of said first group.

* * * * *